US005138218A

United States Patent [19]

Honda et al.

[11] Patent Number: 5,138,218

[45] Date of Patent: Aug. 11, 1992

[54] METAL VAPOR DISCHARGE LAMP HAVING SINGLE END ARC TUBE OF PREDETERMINED THICKNESS

[75] Inventors: Kazuo Honda, Hiratsuka; Atsushi Matsuura, Yokohama; Hisanori Sano; Yasuki Mori, both of Yokosuka, all of Japan

[73] Assignee: Toshiba Lighting and Technology Corporation, Tokyo, Japan

[21] Appl. No.: 638,521

[22] Filed: Jan. 8, 1991

[30] Foreign Application Priority Data

Jan. 14, 1990 [JP] Japan ..... 2-5518

[51] Int. Cl.[5] ..... H01J 61/34

[52] U.S. Cl. ..... 313/25; 313/631; 313/634

[58] Field of Search ..... 313/25, 631, 634

[56] References Cited

U.S. PATENT DOCUMENTS

| | | | |
|---|---|---|---|
| 4,620,130 | 10/1986 | Keeffe et al. | 313/634 |
| 4,717,852 | 1/1988 | Dobrusskin et al. | 313/634 |
| 4,945,288 | 7/1990 | Morris et al. | 313/634 |

FOREIGN PATENT DOCUMENTS

| | | |
|---|---|---|
| 0343625 | 11/1989 | European Pat. Off. . |
| 1-195648 | 8/1989 | Japan . |
| 1-195649 | 8/1989 | Japan . |
| 2211347 | 6/1989 | United Kingdom . |

*Primary Examiner*—Donald J. Yusko
*Assistant Examiner*—John Giust
*Attorney, Agent, or Firm*—Cushman, Darby & Cushman

[57] ABSTRACT

A metal vapor discharge lamp has a small arc tube of a single end type. The maximum and minimum thicknesses of the wall of the arc tube and the ratio of the minimum thickness to the maximum thickness are set to the values in predetermined ranges. The set thicknesses prevents breakage of the arc tube and deterioration of the lamp characteristics.

6 Claims, 2 Drawing Sheets

METAL VAPOR DISCHARGE LAMP HAVING SINGLE END ARC TUBE OF PREDETERMINED THICKNESS

BACKGROUND OF THE INVENTION

1. Field of the Invention

This invention relates to a small metal vapor discharge lamp, and more particularly to a metal vapor discharge lamp of a single end type such as a small metal halide lamp.

2. Description of the Related Art

The conventional metal vapor discharge lamp of a general type such as a metal halide lamp produces a large output and has a large arc tube which is of a double end type.

Recently, a metal vapor discharge lamp such as a small metal vapor discharge lamp such as a metal halide lamp producing a small output. The developed lamp has a small arc tube which is of a single end type.

With the small lamp, the ratio of the electric power supplied to the lamp to the surface area of the discharge space, that is the lamp load, is set to such a high value as 20 to 70 W/cm$^2$ so as to increase the efficiency of the lamp. In order to miniaturize the arc tube, the distance between the electrodes is rendered much smaller than that of the lamp which has a conventional arc tube of a double end type. Accordingly, much metal such as mercury which is sealed in the discharge space is required to obtain necessary lamp characteristics such as the predetermined lamp voltage and the lamp power, inevitably rendering the pressure in the arc tube at the time of lightning to such a very high value as 15 kg/cm$^2$.

In consequence, the arc tube of a small metal vapor lamp must withstand a high temperature and a high inner pressure. The arc tube of a general type is made of quartz glass. When it is disposed under a severe condition as described above at the time of lightening, it is deformed and changes its inner volume, leading to the change of the lamp characteristics and the breakage of the lamp. Further, when the small arc tube is subjected to a high lamp load, the temperature of the coolest portion is apt to be uneven and the lamp characteristics are likely to be varied.

SUMMARY OF THE INVENTION

This invention was made under the above situation, and the object thereof is to provide a vapor discharge lamp having a small arc tube of a single end type, in which the reliability of the arc tube is enhanced, deterioration of the lamp characteristics and breakage of the arc tube are prevented and which has a long life and a high reliability.

In order to attain the object, the thickness of the tube wall of the single-end type arc tube made of quartz glass is limited so as to prevent the above-mentioned disadvantages of the prior art from occurring. The minimum thickness of the tube wall of the arc tube of the lamp according to this invention is limited to at least 1.5 mm. Such limitation of the minimum thickness of the tube wall allows the lamp to withstand a high inner pressure at the time of lightening and to hinder the lamp from being broken.

Further, the maximum wall thickness of the arc tube of the lamp of this invention is limited to at most 3.0 mm, and the ratio of the minimum wall thickness to the maximum wall thickness is limited to at least 0.65. These limitations to the wall thicknesses provide stable lamp characteristics. In other words, part of radiation generated by discharge is absorbed by the arc tube and the convection within the arc tube transmits heat to the wall of the arc tube. The heat is further radiated from the wall. The amount of thus transferred heat through the arc tube varies according to the heat capacity of the arc tube and affects the lamp characteristics. By limiting the maximum thickness of the tube wall, the temperature of the coolest portion of the arc tube can be limited, obtaining the stable lamp characteristics. Further, the limitation of the ratio of the minimum wall thickness to the maximum wall thickness causes very little change in the temperature of the coolest portion of the arc tube, even if the lamp posture changes. When this ratio is limited as described above, the lamp posture at the time of the lightening and the lamp characteristics are stabilized.

The limitation of the ratio of the minimum wall thickness of the arc tube to its maximum wall thickness renders even the stress produced in each part of the wall of the arc tube at the time of lightening so as to reduce deformation of the quartz glass portion of the arc tube due to the inner pressure of the arc tube. Therefore, breakage of the arc tube and deterioration of the lamp characteristics are effectively prevented.

Further, in an aspect of this invention, the distance between the end portion of the metallic foil conductor sealed in a pinch seal portion of the single-end type arc tube and the inner face of the arc tube is limited according to the amount of the sealed mercury. The single-end type arc tube is likely to be broken at the end portion of the metallic foil conductor. However, the arc tube is securely protected from breakage by limiting the distance between the end portion of the metallic foil conductor and the inner face of the arc tube.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
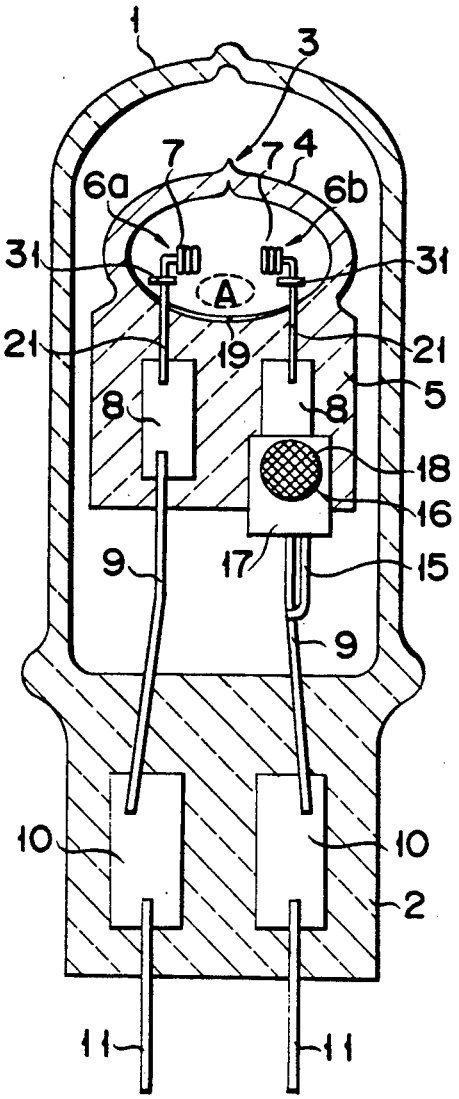
FIG. 1 is a longitudinal cross-sectional view of a lamp according to this invention.

The embodiments of this invention will now be explained with reference to the accompanying drawings.

FIGS. 1 to 4 show a first embodiment of a lamp of this invention. The lamp is a 150 W metal halide lamp having a small arc tube of a single end type. In order to increase the luminous efficiency of the lamp, the lamp load, that is, the ratio of the lamp input to the surface area of the discharge space is set to a high value, more specifically to 20 to 70 W/cm$^2$.

The general structure of the lamp will now be explained. The lamp has an outer bulb 1 which is made of quartz glass and the interior of which is almost evacuated. A pin seal portion 2 is formed on an end of the bulb 1.

Housed in the bulb 1 is an arc tube 3 which is made of quartz glass and of a single end type. The arc tube 3 has a bulb portion 4 and a pinch seal portion 5. Within the arc tube 3 are provided a pair of facing electrodes 6*a* and 6*b*, to the tip end of which coiled discharge portions 7 are fixed.

The electrodes 6*a* and 6*b* are connected to the inner leads 9 by means of metallic foil conductors 8 which are made of molybdenum or the like and are sealed in the pinch seal portion 5 of the arc tube 3. The inner leads 9 are connected to outer leads 11 by means of metallic foil conductors 10 which are made of molybdenum or the like and are sealed in the pinch seal portion 2 of the bulb 1.

The bulb 1 contains a getter assembly 16 which comprises a base plate 17 made of aluminum or the like and a getter 18 formed by Zr-Al alloy which is fixed onto the base plate 17. The getter assembly 16 is connected to one of the inner leads 9 by means of a support line 15.

The structure of the arc tube 3 will now be explained. The arc tube 3 has an inner volume of substantially 0.5 cc and the surface area of the discharge space of its interior is substantially 3.5 cm$^2$. Within the arc tube 3 are sealed a predetermined amount of mercury, halide compound of sodium, thallium, indium or the like and a starter rare gas. In this embodiment, the amount of the sealed mercury is 2.8 mg/cc and the sealed metal halide compound is $SnI_2$, NaI, TlI, InI, NaBr, LiBr or the like.

With this lamp, the amp voltage at the time of normal lightning is 95 V, the lamp current is 18 A and the lamp input power is 150 W. The lamp load at the time of lightening, that is, the input power per unit surface area of the discharge space is set to 43 W/cm$^2$ which is approximately twice as high as the conventional lamp of this kind. The pressure in the arc tube 3 at the time of lightening is such a high pressure as approximately 20 kg/cm$^2$.

Figure 2:
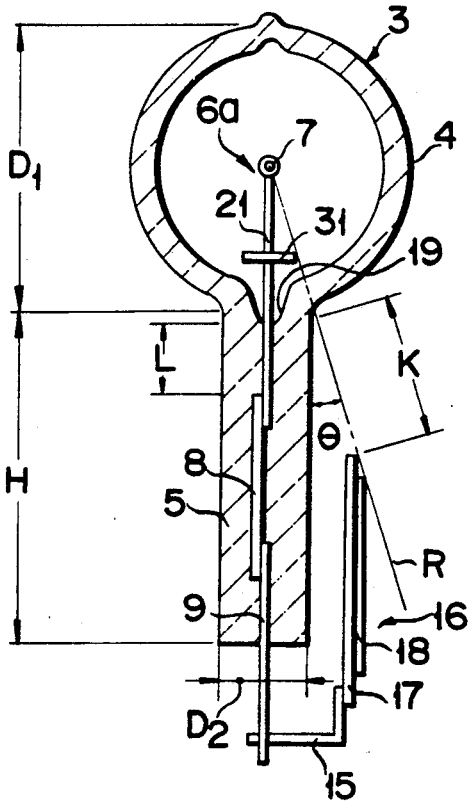
FIG. 2 is a longitudinal cross-sectional view of the arc tube of the lamp as viewed from a lateral side of the lamp in FIG. 1.
Figure 3:
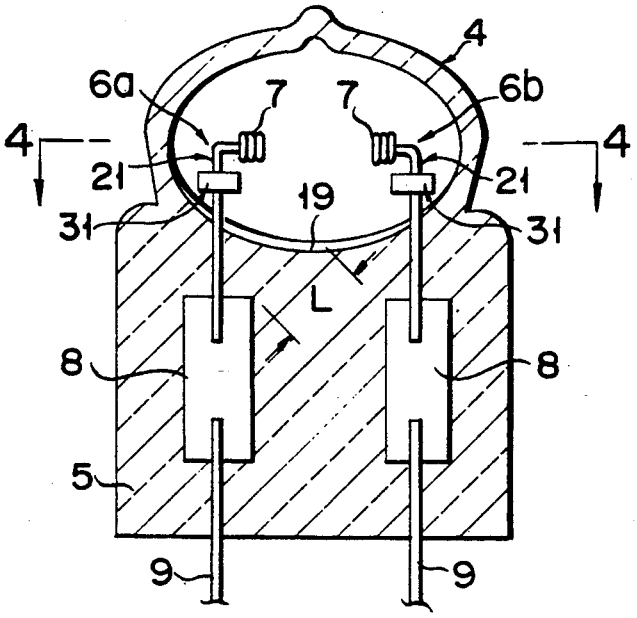
FIG. 3 is a longitudinal cross-sectional view of the arc tube of the lamp in FIG. 1.

Let it be assumed in this invention that the lamp input voltage is Wi (watts), the inner volume of the discharge space is V (cc), the amount of the sealed mercury is P (mg), the surface area of the discharge space is S (cm$^2$), the maximum thickness of the wall of the bulb portion 4 of the arc tube 3 is Dmax (mm), and its minimum thickness is Dmin (mm) as shown in FIG. 2, the lamp load Wi/S falls in the following range showing a high value:

$$20 \leqq Wi/S \leqq 70 (W/cm^2)$$

The amount of the sealed mercury per unit discharge space P/V takes the following high value:

$$P/V \geqq 15 (mg/cc)$$

By setting the lamp load and the amount of the sealed mercury to high values as mentioned above, the value of practically sufficient lamp efficiency can be obtained, and the distance between the electrodes can be made small to miniaturize the lamp.

For the purpose of preventing breakage of the arc tube 3 and deterioration of the lamp characteristics, Dmin, Dmax and Dmin/Dmax are selected as:

$$Dmin \geqq 1.5 \text{ (mm)}$$

$$Dmax \leqq 3.0 \text{ (mm)}$$

$$Dmin/Dmax \geqq 0.65$$

The setting of the wall thicknesses of the bulb portion 4 of the arc tube 3 to the above-mentioned ranges can avoid deformation and breakage of the arc tube 3 and deterioration of the lamp characteristics.

In other words, breakage of the arc tube 3 due to the inner pressure of the arc tube 3 is securely prevented by setting the minimum wall thickness Dmin of the bulb portion 4 of the arc tube 3 to at least 1.5 mm.

If, however, the maximum wall thickness Dmax of the bulb portion 4 of the arc tube 3 is too thick, the lamp characteristics become unstable. Part of radiation from the arc generated in the arc tube 3 is absorbed by the bulb portion 4, and the convection of the gas in the arc tube 3 also transmits heat to the bulb portion 4. The heat transmitted to the bulb portion 4 is radiated from the bulb portion 4. The amount of heat transmitted to the bulb portion 4 and radiated therefrom change according to the heat capacity of the bulb portion 4.

Accordingly, if the wall thickness, that is, the heat capacity of the bulb portion 4 is too large, the temperature of the coldest part of the bulb portion 4 cannot be maintained in a preferable range, lowering the lamp characteristics. When, however, the maximum wall thickness Dmax of the bulb portion 4 is limited to the value in the above-mentioned range, this disadvantage does not occur.

The setting of the ratio Dmin/Dmax of the minimum wall thickness to the maximum wall thickness to the value in the above-defined range provides stable lamp characteristics. The lamp characteristics changes according to the pressure of metal vapor in the arc tube at the time of lightening, and the pressure of the metal vapor varies depending on the temperature of the coldest portion of the arc tube 3. In general, the coldest portion appears at the region A under the arc. Depending on the posture of the lamp at the time of lightening, part of the bulb portion 4 is disposed under the arc. When the wall thickness of the bulb portion 4 greatly varies, the temperature of the coolest part also greatly varies so that the lamp characteristics are changed very much. However, when the thickness ratio Dmin/Dmax is selected so as to fall in the above-mentioned range, very few change in the temperature occurs to the coolest part when the lamp takes any posture, making the lamp characteristics stable.

By setting of the Dmin/Dmax to the value within the range as set out above, the arc tube 3 withstands a high inner pressure.

The arc tube 3 withstand a high inner pressure, however, the variation of the wall thickness, that is, Dmin/Dmax is limited to the value within the above-mentioned range, the arc tube 3 withstand a higher inner pressure.

The conditions for the wall thickness limitation of the bulb portion 4 were obtained by testing many arc tubes manufactured on an experimental basis.

The wall thickness of the bulb portion 4 of the arc tube 3 can be controlled by changing manufacturing method of the arc tube 3. The arc tube has been manufactured in the following steps. First, a tube having a predetermined length is cut from a long pipe made of quartz glass. One end portion of the tube is heat-softened, it is inserted into a mold and is formed into a substantially semi-spherical shape to provide a head portion of the arc tube.

Sometimes part of the quartz glass tube is extended and thin portion is formed in the vicinity of the head portion. In order to avoid this disadvantage, it is preferred that the one end portion of the tube be compressed in its axial direction by its own weight or by means of the mold or the like after the one end of the tube has been heat-softened so that the wall thickness of the portion in the vicinity of the one end portion is previously made thick and that thereafter the one end portion be formed substantially semi-spherical. With the arc tube 3 manufactured by this method, the wall thickness of the bulb 4 is accurately controlled so that it falls within the range as defined above.

The embodied lamp is prevented from breakage by another feature.

As the result of the tests of the lamps manufactured on the experimental basis, it was found that most breakage occurred at the upper portions of the metallic foil conductors 8, that is, the portions in the vicinity of the lateral side portions of the bulb portion 4. These portions are close to the arc, resulting in high temperature and high stress exerted thereon due to the thermal expansion difference between the quartz glass of the pinch seal portion 5 and the metallic foil conductors. Since a grooved depression 18 is formed in the vicinity of the pinch seal portion 5 upon producing the portion 5 between the paired molds, stress is concentrated to the portion in the vicinity of the bottom portion of the depression 19. These causes cooperate to break the related portion frequently.

TABLE 1

| Amount of Sealed Mercury per Unit Volume M (mg/cc) | Minimum Distance between Inner Wall of Arc Tube and Metallic Foil K (mm) | L/M | Occurrence of Breakage | Judgement |
|---|---|---|---|---|
| 40 | 0.3 | 0.0075 | yes | No Good |
| 40 | 0.5 | 0.013 | yes | No Good |
| 40 | 0.7 | 0.018 | no | Good |
| 40 | 1.0 | 0.025 | no | Good |
| 40 | 2.0 | 0.05 | no | Good |
| 40 | 3.0 | 0.075 | no | Good |
| 30 | 0.3 | 0.01 | yes | No Good |
| 30 | 0.5 | 0.017 | yes | No Good |
| 30 | 0.7 | 0.023 | no | Good |
| 30 | 1.0 | 0.033 | no | Good |
| 30 | 2.0 | 0.067 | no | Good |
| 30 | 3.0 | 0.10 | no | Good |
| 50 | 0.3 | 0.006 | yes | No Good |
| 50 | 0.5 | 0.01 | yes | No Good |
| 50 | 0.7 | 0.014 | yes | No Good |
| 50 | 1.0 | 0.02 | no | Good |
| 50 | 2.0 | 0.04 | no | Good |
| 50 | 3.0 | 0.06 | no | Good |

The inventors of this invention manufactured many lamps which had various shapes and sizes of the pinch seal portions 5 and the metallic foil conductors 8 and had different conditions and lit them for 3,000 hours to see whether the lamps were broken or not. Examples of the test results are shown in Table 1.

From the analysis of the test results, it was found that the occurrence of breakage of the relation portion depends on the ratio L/M of the minimum distance L between the end portion of the metallic foil conductor 8 and the inner face of the arc tube 3 to the amount of sealed mercury per unit volume M (=P/V). If the condition $$L/M \geqq 1.8\times10^{-2}\ (mm\cdot cc/mg)$$

is satisfied, it was found that the pinch seal portion 5 is ensured to be prevented from being broken.

However, too large L/M causes another disadvantage. The large L/M leads to the fact that the shafts 21 of the electrodes 6a and 6b embedded in the pinch seal portion 5 is long. Between the outer periphery of the electrode shaft 21 and the quartz glass therearound is formed a small gap due to the difference between the coefficients of thermal expansion. Part of the sealed material intrudes into the gap. Since the intruded sealed material is not evaporated even at the time of lightening, the vapor pressure of the sealed material at the time of lightening is decreased by the degree corresponding to the amount of the intruded sealed material. The amount of the sealed material intruded into the gap varies from product to product and thus it is difficult to control the intruding amount accurately. Therefore, the longer the electrode shaft 21, the more the vapor pressure of the sealed material varies at the time of lightening. Large variation of the vapor pressure of the sealed material at the time of lightening leads to a large change in the lamp characteristics and the color rendering property.

It was found that these disadvantages are practically overcome if the condition $$L/M \leqq 6.5\times10^{-1}\ (mm\cdot cc/mg)$$

is satisfied.

Figure 5:
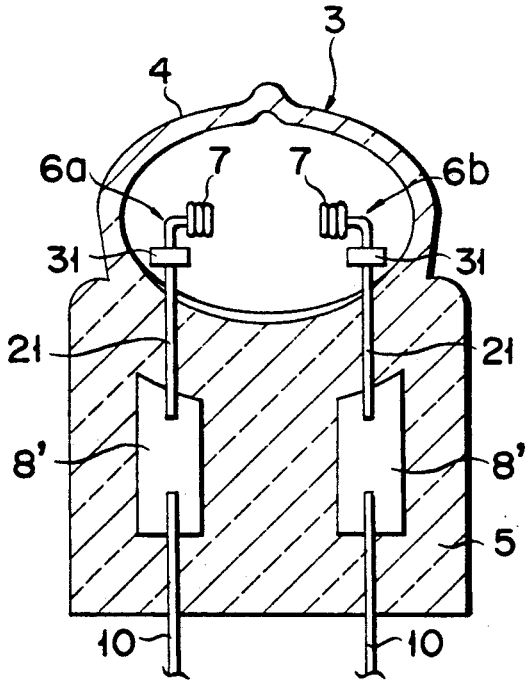
FIG. 5 is a longitudinal cross-sectional view of another embodiment of the arc tube of a lamp in which the shape of the metallic foil conductor is modified.

If the value of L/M is increased, the size of the pinch seal portion 5 is adversely enhanced. In order to limit the L/M to the value within the range as described above and in order to decrease the size of the pinch seal portion 5, therefore, it is effective to form the end portion of each metallic foil conductor 8' in conformity with the shape of the inner face of the bulb portion 4 of another embodiment as shown in FIG. 5.

The lamp of the second embodiment has another feature for preventing deterioration of the inner face of the bulb portion 4.

As in the first embodiment, a getter assembly 16 for absorbing gas is provided in the bulb 1 so as to maintain a vacuum state therein. As ultraviolet rays included in the radiation from the arc are incident on the getter assembly 16, electrons are emitted from the getter assembly 16 due to the photo-electric effect. The emitted electrons attract the sealed metal atoms in the arc tube 3 and the metal atoms pass through the wall of the bulb portion 4 of the arc tube 3 to the outer atmosphere. Specifically, sodium has smaller atomic radius than the other sealed metals and thus it is easier to pass through the quartz glass of the bulb portion 4. This allows sodium to be easily lost from the interior of the arc tube 3.

In this respect, it is preferred that the getter assembly 16 be disposed at the place where it is exposed to possibly few ultraviolet rays. The getter must be heated to a predetermined temperature to perform a predetermined operation. From this, the getter assembly must be positioned at a place where its temperature can be maintained at a predetermined value. It is not preferable, however, that the change of the position of the getter assembly 16 cause increase of the outer bulb 1.

These conditions are obtained by accurately limiting the position of the getter assembly 16. Referring to FIG. 2, let it be assumed that the outer diameter of the bulb portion 4 of the arc tube 3 is $D_1$, the thickness of the pinch seal portion 5 is $D_2$, the minimum distance between the getter assembly 16 and the bulb portion 4 is K, the angle defined by the lateral side of the pinch seal portion 4 and a plane R including a straight line connecting the discharge portions 7 at the tips of the paired electrodes 6a and 6b 16 which is closest to the bulb portion 4 is $\theta$, and the height of the pinch shield portion 5 is H, the getter assembly 16 may be arranged in accordance with the following expressions to satisfy the above-mentioned conditions:

$\tan\theta \leqq D_2/D_1$ $K \geqq H/2\cos\theta$

After repeating scattering and total reflection at the lateral side of the pinch seal portion 5, the portion of the ultraviolet rays which is emitted on the upper end face of the pinch seal portion 5 is radiated from the lower face of the pinch seal portion 5. A small amount of ultraviolet rays is emitted on the portion of the pinch seal portion 5 from which the arc is shaded, that is, the range under the plane R.

Accordingly, if the condition $\tan\theta \leqq D_2$ is satisfied, the getter assembly 16 is disposed behind the pinch seal 5, reducing the amount of the radiated ultraviolet rays. The temperature of the getter 18 of the getter assembly 16 must be maintained at a predetermined value at the time of lightening. In this connection, the getter assembly 16 must be arranged close to the arc tube 3 to some extent.

Further, it is preferred that the getter assembly 16 be disposed close to the arc tube 3 so as to render the outer tube 1 small. On the contrary, if the minimum distance K between the getter assembly 16 and the valve 5 is too small, a lot of ultraviolet rays are radiated. In order to find a proper condition for the minimum distance K, 100 lamps which were manufactured on an experimental basis and had different lengths between the getter assemblies 4 and the bulb portions 4 and other different factors were tested whether sodium was lost from the lamps in 3000 hours. The experimental results are shown in Table 2.

From these results, it was found that, when the condition $K \geqq H/2\cos\theta$ is satisfied, small amount of ultraviolet rays is emitted on the getter assembly and sodium is not lost from the lamps.

TABLE 2

| H cos θ | Sodium was Lost |
|---|---|
| 0.25 | yes |
| 0.33 | yes |
| 0.5 | no |
| 0.75 | no |
| 1.0 | no |

Further, If the getter assembly 16 is separated from the bulb 4 too much or the value K is too large, the temperature of the getter 18 cannot be maintained at the predetermined operating value and the bulb 1 is rendered large. Accordingly, it is preferred that $K \leqq H.$ With the lamp which has the getter assembly 16 connected to one of the inner leads 9 by means of the support line 15 like the embodiments of this invention, electrolytic cracks are likely to be produced in the pinch seal portion 5 due to the potential difference between the other inner lead 9 and the corresponding metallic foil conductor 8. It is preferred that the distance between the getter assembly 16 and the other metallic foil conductor 8 be at least 3 mm for the prevention of the electrolytic cracks.

Some outer bulbs 1 contain other metal members than the getter assemblies, for example, starter etc. which members have photo-electric effect by receiving ultraviolet rays. These members are arranged in the arc tube similarly to the getter assembly.

This embodied lamp has a further feature for miniaturizing the arc tube 3 and preventing breakage thereof.

The larger the distance between the paired electrodes 6a and 6b, the higher the lamp voltage. It means that the distance between the discharge portions 7 must be made large to some extent in order to obtain a predetermined high lamp voltage. If, however, the distance between the discharge portions 7 is made large, the arc tube 3 is rendered large. Specifically, with the single end type arc tube, the distance between the discharge portions is more and more shortened, because the tip portions of the electrode shafts 21 are bent toward each other to prevent the discharge between the electrodes 6a and 6b of the electrode shafts 21.

Figure 4:
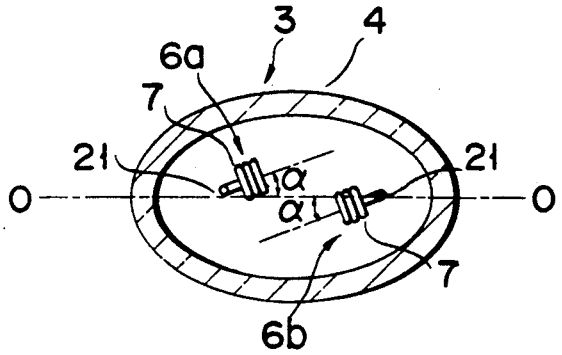
FIG. 4 is a cross-sectional view along line 4—4 of FIG. 3.

In the embodiment as shown in FIG. 4, the electrodes 6a and 6b are arranged in a state rotated through the same predetermined angles in the opposite directions around their electrode shafts 21.

With this structure, the discharge portions 7 forming or formed on the tip portions of the electrodes 6a and 6b are displaced through the angle $\alpha$ in the opposite directions with respect to a straight line O—O of the bulb portion 4 connecting the neck portions of the electrodes 6a and 6b and included in a plane containing the electrode shafts 21. This arrangement requires a large distance between the discharge portions 7. In this case, the corresponding ends of the coiled discharge portions do not face each other, but, if the angles $\alpha$ are not so large, such disagreement little affect the discharge characteristic.

The embodied small arc tube has a further feature for eliminating extraordinary discharge.

With the small arc tube, as described above, it is difficult to make the distance between the paired electrodes 6a and 6b, and a large lamp load wears the discharge portions 7 heavily. At the end of the life, the discharge portions 7 are scattered and discharge occurs between the electrodes 21. When this extraordinary discharge takes place, the arc between the electrode shafts 21 moves downward to approach the pinch seal portion 5 of the arc tube 3. The pinch seal portion 5 is heated to a high temperature, and in consequence the arc tube 3 is likely to be broken.

In order to protect the arc tube from this disadvantage in this embodiment, each discharge portion 7 comprises a coil which has a diameter of, for example, substantially 0.5 mm and is made of a material having a high melting point such as tungsten or thoriated tungsten consisting of tungsten of substantially 98% and thorium of substantially 2%, and each electrode shaft 7 comprises a wire which has a diameter of, for example, 0.5 mm and is made of a material having a melting point lower than the material of the discharge portion 7 such as a rhenium-tungsten alloy.

Discharge blocking members 31 are fixed to the portions of the electrode shafts 7 which are close to the pinch seal portion 5. Each discharge blocking member 31 has a shape of a short pipe, a disc or the like and is made of a discharge-free material such as quartz glass or ceramic.

Where the discharge portions 7 happen to be scattered and extraordinary discharge occurs between the electrode shafts 7, the electrode shafts 21 made of a material of a low melting point is melted or deformed so that the tip portions thereof assume a discharge-free shape such as a sphere to terminate the discharge. Even if the extraordinary discharge is not stopped after the electrode shafts 21 has melted or deformed and the arc moves downward, the discharge is securely stopped at the discharge blocking portions 21, whereby the arc tube 3 is prevented from being broken.

Part of each electrode shaft 21 may be made thin so that the electrode shaft 21 can easily been melted or deformed at this part.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A metal vapor discharge lamp having a small arc tube comprising:

an outer bulb;

an arc tube of a single end type made of quartz glass and housed in said outer tube, said arc tube having a bulb portion defining a discharge space therein and a single end type pinch seal portion; and a pair of electrodes extending in said discharge space, wherein $$20 \leqq Wi/S \leqq 70 \ (W/cm^2)$$

$$P/V \geqq 15 \ (mg/cc)$$

$$Dmin \geqq 1.5 \ (mm)$$

$$Dmax \leqq 3.0 \ (mm)$$

$$Dmin/Dmax \geqq 0.65$$

where Wi is an lamp input power of said arc tube, V is a volume of said discharge space, S is a surface area of said discharge space, P is an amount of mercury sealed in said discharge space, Dmax is a maximum thickness of a wall of said bulb portion, and Dmin is a minimum thickness of said wall of said bulb portion.

2. The lamp according to claim 1, wherein a pair of metallic foil conductors are embedded in said pinch seal portion, and $$L/M \geqq 1.8 \times 10^{-2} (mm \cdot cc/mg)$$

where

L is a shortest distance between said metallic foil conductors and an inner face of said bulb portion, and M equals P/V.

3. The lamp according to claim 1, wherein said outer bulb contains a built-in element having photoelectric effects, and said electrodes comprise an electrode shaft having a bent tip portion, and $$\tan\theta \leqq D_2/D_1$$

$$K \geqq H/2\cos\theta$$

where $D_1$ is an outer diameter of said bulb portion, $D_2$ is a thickness of said pinch seal portion, H is a height of said pinch seal portion, $\theta$ is an angle defined between a lateral face of said pinch seal portion and a plane including a straight line which connects the tips of said electrodes and a portion of said built-in element which is the closest to said bulb portion, and K is a distance between said portion of said built-in element and said bulb portion.

4. The lamp according to claim 1, wherein each of said electrodes comprises an electrode shaft having a bent tip portion and a discharge portion formed on said tip portion of said electrode shaft, said electrode shafts being arranged in parallel with each other, said discharge portions being arranged in a state rotated through a predetermined angle in the opposite directions with respect to a plane including said electrode shafts.

5. The lamp according to claim 1, wherein each of said electrodes comprises an electrode shaft having a bent tip portion and a discharge portion formed on said tip portion of said electrode shaft, said discharge portion being made of a material having a high melting point, said electrode shaft being made of a material having a melting point lower than said melting point of said material of said discharge portion.

6. The lamp according to claim 1, wherein each of said electrodes comprises an electrode shaft having a tip portion and a discharge portion formed on said tip portion of said electrode shaft, and a discharge blocking member is provided between said discharge portion and said pinch seal portion on said electrode shaft.

* * * * *